US010899505B2

(12) United States Patent
Neputy et al.

(10) Patent No.: US 10,899,505 B2
(45) Date of Patent: Jan. 26, 2021

(54) BAND-RECEIVING CLOSURE WITH RECESS

(71) Applicant: Silgan White Cap LLC, Downers Grove, IL (US)

(72) Inventors: Darren Neputy, Palos Hills, IL (US); Kevin Orth, Des Plaines, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 37 days.

(21) Appl. No.: 16/244,698

(22) Filed: Jan. 10, 2019

(65) Prior Publication Data

US 2020/0223597 A1 Jul. 16, 2020

(51) Int. Cl.
*B65D 41/34* (2006.01)

(52) U.S. Cl.
CPC ..... *B65D 41/3423* (2013.01); *B65D 41/3428* (2013.01); *B65D 2401/30* (2020.05)

(58) Field of Classification Search
CPC ..... B65D 41/3423; B65D 41/3428; B65D 2101/0046
USPC ..... 215/252
See application file for complete search history.

(56) References Cited

U.S. PATENT DOCUMENTS 5,356,019 A * 10/1994 Kelly ..... B65D 41/3428 215/252
5,755,347 A * 5/1998 Ingram ..... B29C 57/00 215/252
6,085,921 A * 7/2000 Brown ..... B65D 41/3428 215/252
6,405,886 B1 6/2002 Gearhart et al.
8,648,203 B2 4/2014 Krautkrämer
D723,919 S 3/2015 Taber et al.
2001/0002661 A1* 6/2001 Reidenbach ..... B65D 41/3428 215/252
2001/0027957 A1* 10/2001 Kano ..... B65D 41/0421 215/341
2004/0026288 A1* 2/2004 Zumbuhl ..... B65D 41/3428 206/459.1
2006/0283828 A1* 12/2006 Falzoni ..... B65D 41/3428 215/200
2017/0066164 A1* 3/2017 Luzzato ..... B29C 45/0081

FOREIGN PATENT DOCUMENTS

FR 2863589 6/2005
FR 2911584 7/2008
WO WO91/17090 11/1991

OTHER PUBLICATIONS

International Searching Authority, "International Search Report and Written Opinion," issued in connection with International Application No. PCT/US2020/012165, dated Apr. 27, 2020, 10 pages.

* cited by examiner

*Primary Examiner* — James N Smalley
(74) *Attorney, Agent, or Firm* — Reinhart Boerner Van Deuren s.c.

(57) ABSTRACT

A closure with a top panel, a skirt extending downward and away from the top panel, frangible connections that connect the skirt to a tamper band. The frangible connections provide a visual indication, when broken, that the closure has been opened. The tamper band includes a sidewall coupled to the frangible connections, the sidewall including a recess in which a pivotable engagement structure is displaced while the closure is applied to a container.

17 Claims, 7 Drawing Sheets

BAND-RECEIVING CLOSURE WITH RECESS

BACKGROUND OF THE INVENTION

The present disclosure relates generally to closures, and in particular to closures with a tamper band to evidence when the closure has been removed. One method of manufacturing closures starts by forming the closure, cutting a line of frangible connections around a bottom of the closure's skirt, and then applying the closure to a container inlet. On occasion the frangible connections break during application of the closure to the container inlet. This disclosure describes a closure with a recess in an interior surface of a tamper band to reduce the deflection of the container engagement structure when the closure is applied to a container.

SUMMARY OF THE INVENTION

In one embodiment, a closure comprises a generally circular top panel centered about a vertical axis. The top panel comprises an upper surface, a lower surface and an outer periphery. A skirt extends downward and away from the outer peripheral edge of the top panel. The skirt comprising an inner surface and a thread formed about the inner surface. Frangible connections connect the skirt to a tamper band and provide a visual indication, when broken, that the closure has been opened decoupling the tamper band from the skirt. The tamper band comprises a sidewall coupled to the frangible connections, the sidewall comprising an inner surface facing towards the vertical axis, and the inner surface comprising a recess. The tamper band also comprises a connection point disposed at a bottom of the sidewall. The tamper band also comprises a container engagement structure pivotably coupled to the sidewall via the connection point. The container engagement structure pivots in a first rotational direction into the recess when the closure is applied to a container.

A portion of the container engagement structure is disposed within the recess at the moment of greatest deflection while the closure is being applied to a container. In various embodiments the percentage of the container engagement structure disposed within the recess is at least 10%, at least 20%, and at least 25%.

Various embodiments of the invention relate to any of the features, structures, elements, parameters, method steps, systems, components, subsystems, etc. described and shown herein, and various embodiments of the invention relate to any combination the features, structures, elements, parameters, method steps, systems, components, subsystems, etc. described and shown herein.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

This disclosure provides a description for various embodiments of a closure with a recess that reduces that amount of deflection of the closure's sidewall while being applied to a container. As a result of the reduced deflection, there is a correspondingly reduced amount of stress places upon the frangible connections and therefore a reduced chance of one of the frangible connections breaking during application of the closure to a container.

Figure 1:
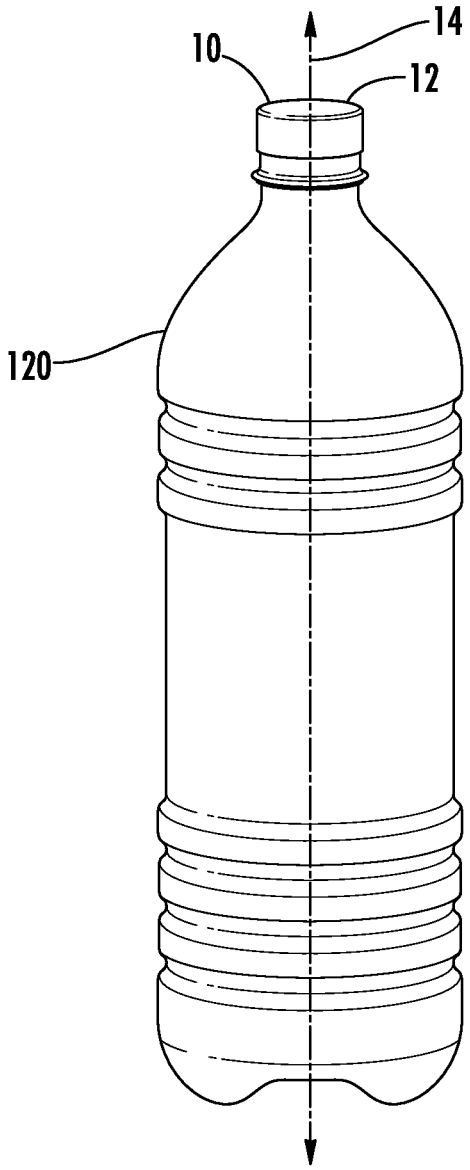
FIG. 1 is a perspective view of a container with a closure affixed, according to one embodiment.

Turning to FIG. 1, a container, shown is water bottle 120, is depicted with closure 10 affixed, according to an exemplary embodiment. Closure 10 comprises an end wall or top portion, shown as a top panel 12 centered around axis 14. Top panel 12 is generally circular in shape and is generally planar. Closure 10 includes an outer periphery 72 and a wall, shown as skirt 18, extending outwardly and downwardly from closure 10, both of which are centered around axis 14.

Figure 2:
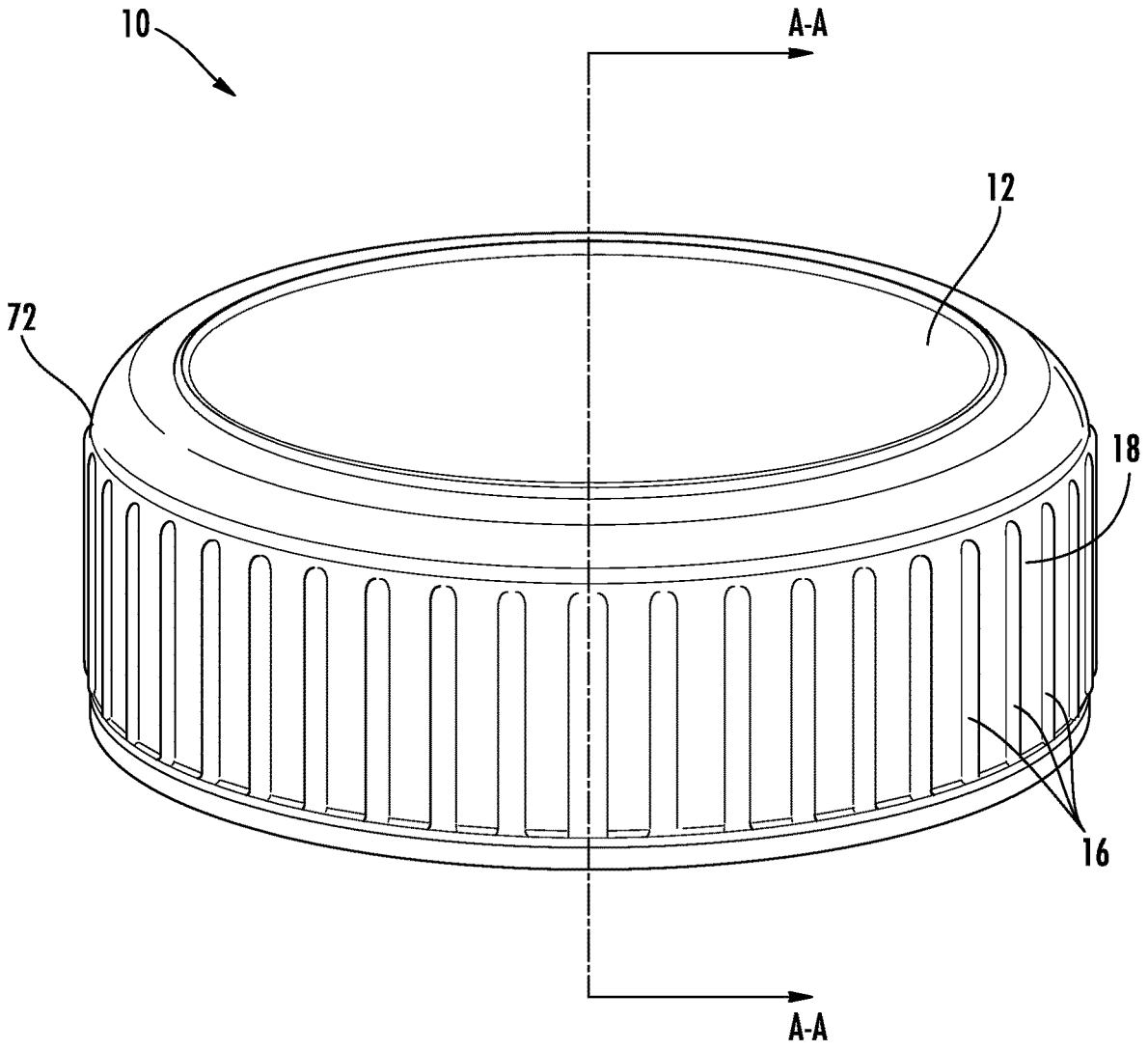
FIG. 2 is a perspective view of a closure, according to one embodiment.

Skirt 18 is generally annular in cross-section and is substantially perpendicular to a plane-defined top panel 12. As depicted in FIGS. 1 and 2, closure 10 optionally comprises a plurality of raised ribs 16 extending radially outward from an outer surface of skirt 18. Ribs 18 extend vertically along at least a portion of the vertical length of the outer surface of skirt 18 to provide a textured or gripping surface that may facilitate opening of the closure 10.

Figure 3A:
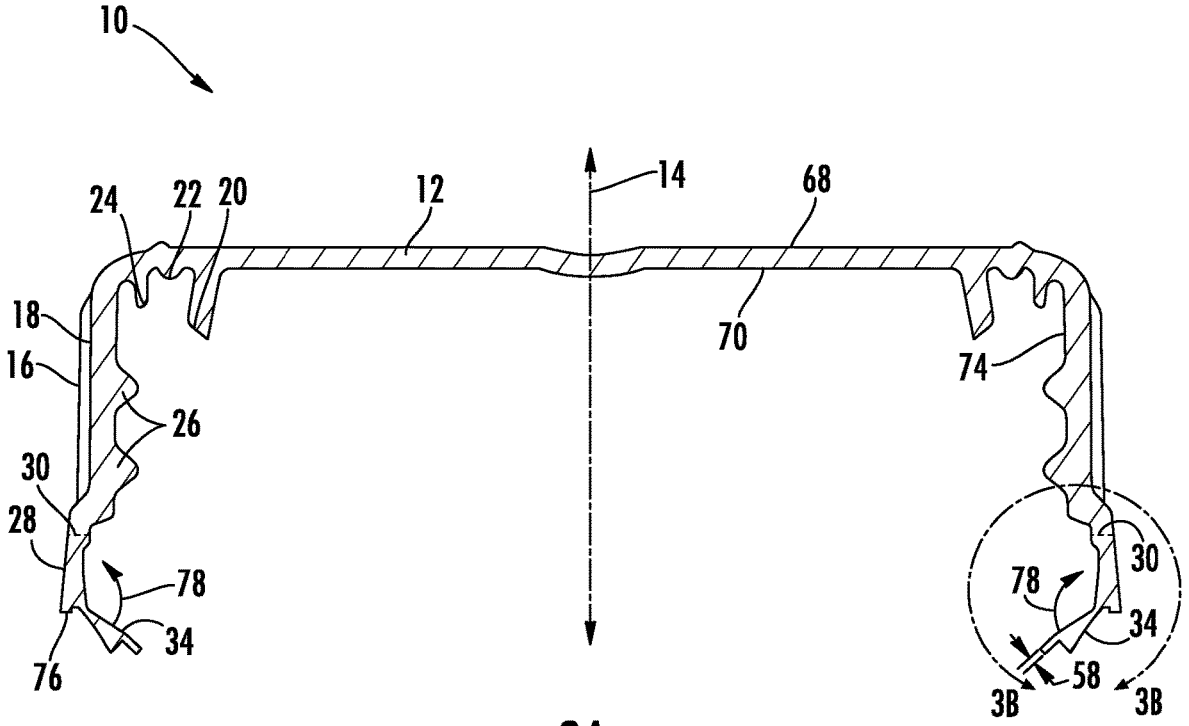
FIG. 3A is a cross-sectional perspective view of the closure of FIG. 2 along line A-A, according to one embodiment.
Figure 3B:
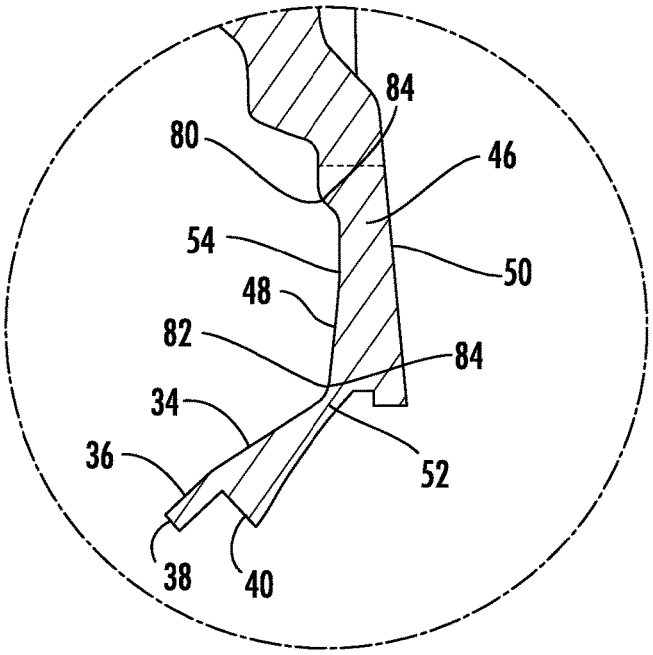
FIG. 3B is a detailed perspective view of a portion of the closure of FIG. 3A, according to one embodiment.
Figure 4A:
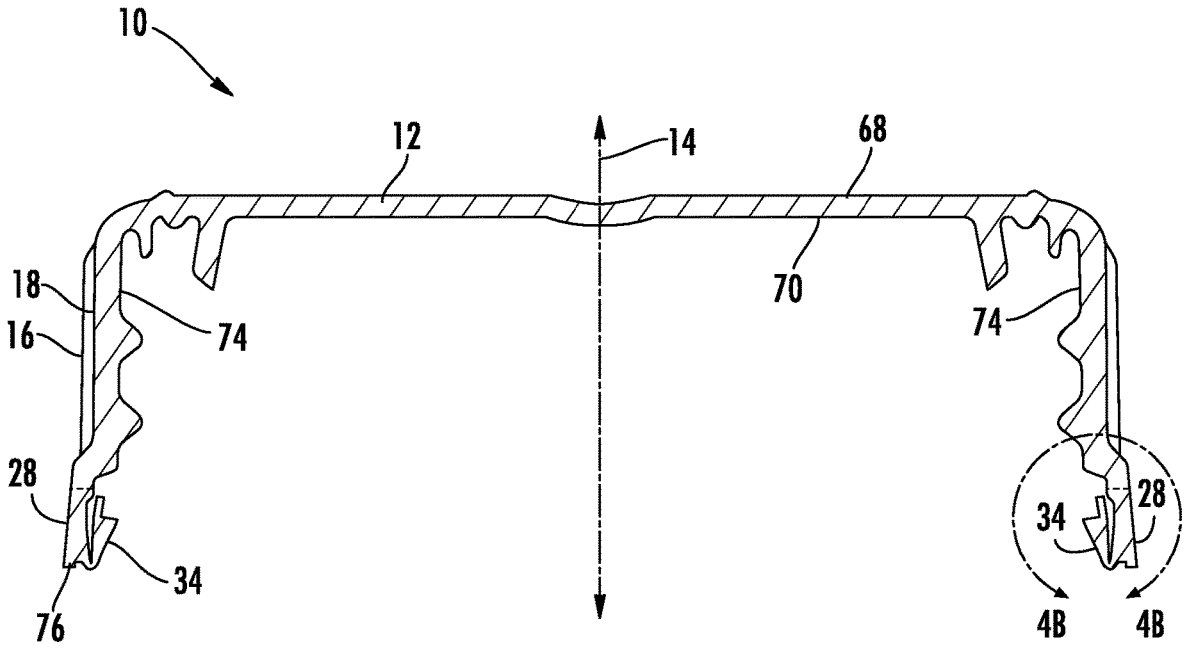
FIG. 4A is a cross-sectional perspective view of the closure of FIG. 2 along line A-A, according to one embodiment.
Figure 4B:
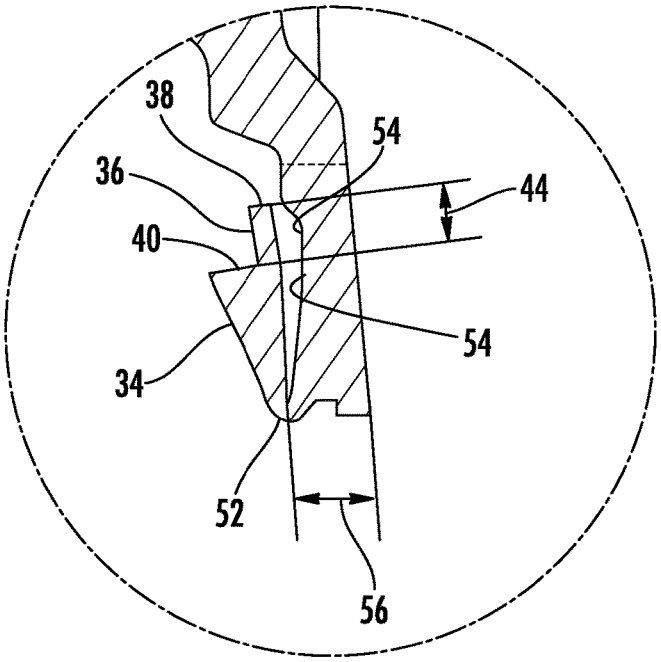
FIG. 4B is a detailed perspective view of a portion of the closure of FIG. 4A, according to one embodiment.

Located along the inner surface of the skirt 18 is a container engagement structure configured to interact with a corresponding closure engagement structure located on the neck of the container to which the closure 10 is to be sealingly applied. As shown in FIG. 3A, in one embodiment the container engagement structure comprises thread 26 that extends inwardly from inner surface 74 of skirt 14. Thread 26 is configured to engage corresponding threading present on the container to which closure 10 is attached. In various other embodiments, closure 10 may include any other number of types of engagement structures, such as but not limited to snap beads, lugs, etc.

In some embodiments, closure 10 may further include a tamper evidencing structure configured to provide indication to a user that the initial sealing engagement between the closure 10 and container has been disrupted as a result of the closure 10 being partially or entirely removed from the container. As shown in FIG. 3A, in one embodiment the tamper evidencing structure comprises tamper band 28 coupled to a lower end of skirt 18 by a series of frangible connections 30. Upon application of twisting force to closure 10 to remove closure 10 from a container, frangible connections 30 are configured to break, separating tamper band 28 from skirt 18.

A series of plugs 20, 22 and 24 engage against the container inlet to seal the contents of container. Plugs 20, 22 and 24 extend generally downward from lower surface 70 of top panel 12 in a direction away from upper surface 68 of top panel 12. In various embodiments, plugs 20, 22 and 24 are formed as annular, uninterrupted, continuous rings or walls extending 360 degrees about the lower surface 70 of the top panel 12. By these three plugs 20, 22 and 24, closure 10 provides a mechanism of multiple fluid seals, arranged in series, to provide a method for pressure in the container to be relieved. Therefore, the chances of a container breaking are correspondingly reduced. In the embodiments depicted, closure 10 includes first plug 20, second plug 22 and third plug 24, but it is contemplated herein that closure 10 may include any number and/or combination of first plug 20, second plug 22 and third plug 24 and still practice the teachings of this disclosure.

In various embodiments, the closures 10 discussed herein may be of various sizes intended to seal containers of various sizes and having various contents. In some exemplary embodiments, the closures 10 are configured to seal containers such as metal, glass or plastic containers or bottles for holding liquids, granular materials, food, etc. In various embodiments, plugs 20, 22 and 24 of the closures 10 discussed herein are suitable for maintaining a hermetic seal with the container neck finish to which the closure 10 is attached.

Figure 5A:
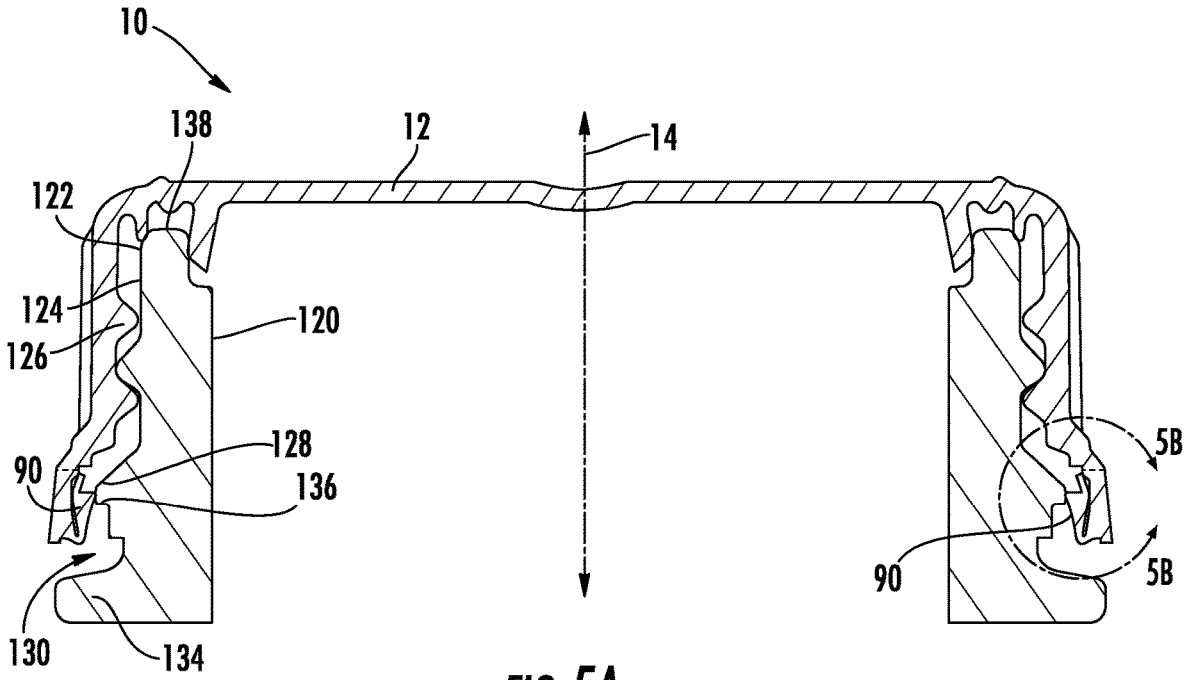
FIG. 5A is a cross-sectional perspective view of the closure of FIG. 2 along line A-A, according to one embodiment.
Figure 5B:
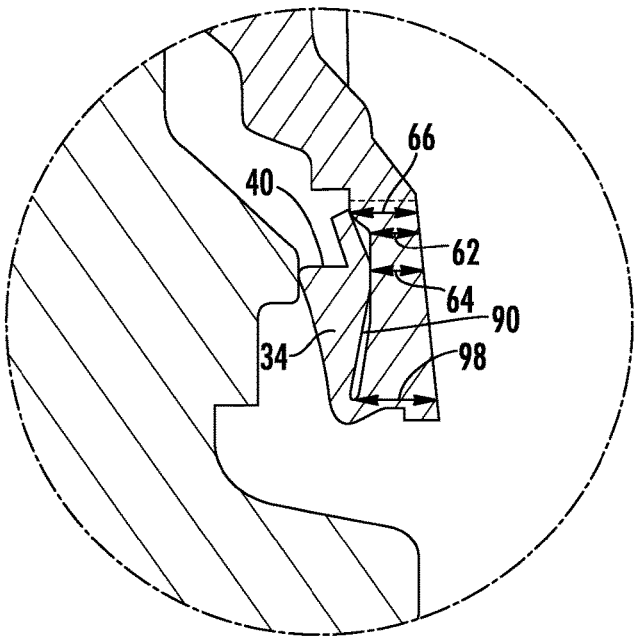
FIG. 5B is a detailed perspective view of a portion of the closure of FIG. 5A, according to one embodiment.
Figure 5C:
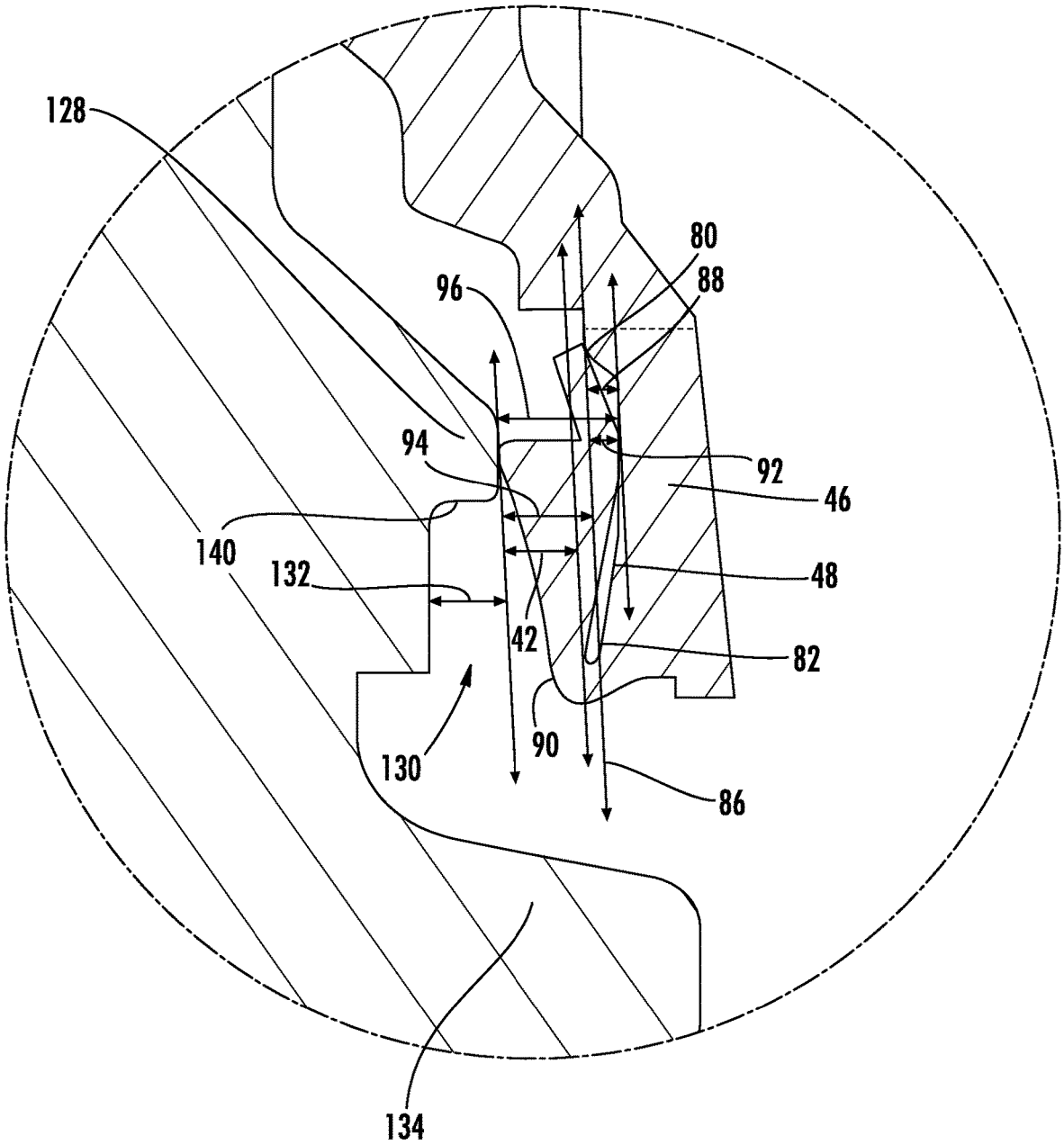
FIG. 5C is a detailed perspective view of a portion of the closure of FIG. 5A, according to one embodiment.
Figure 6A:
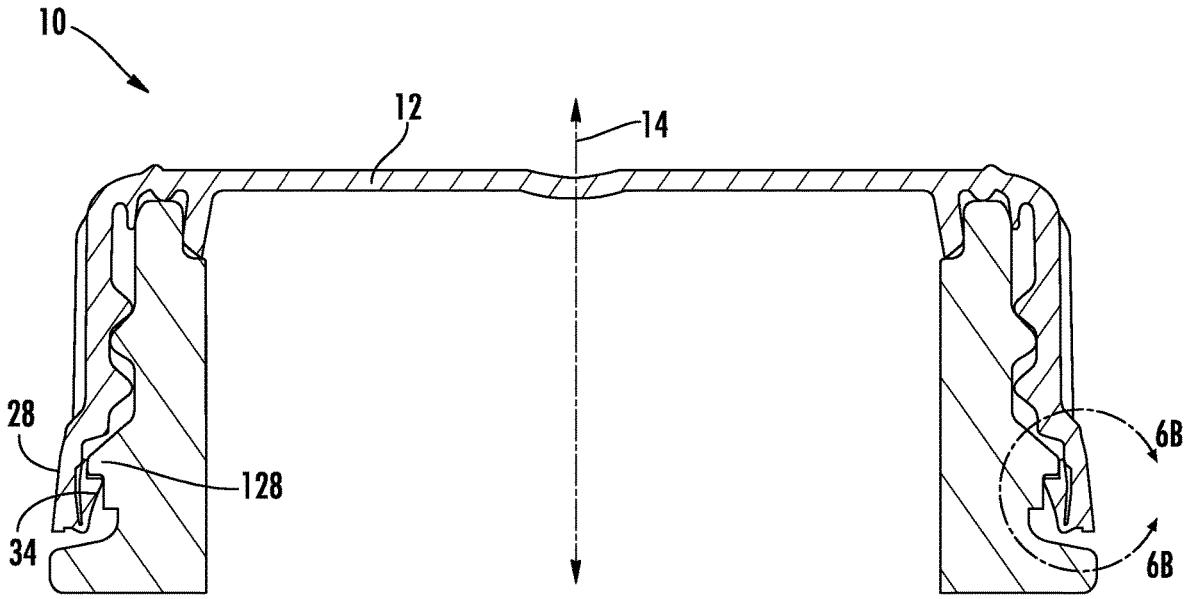
FIG. 6A is a cross-sectional perspective view of the closure of FIG. 2 along line A-A, according to one embodiment.
Figure 6B:
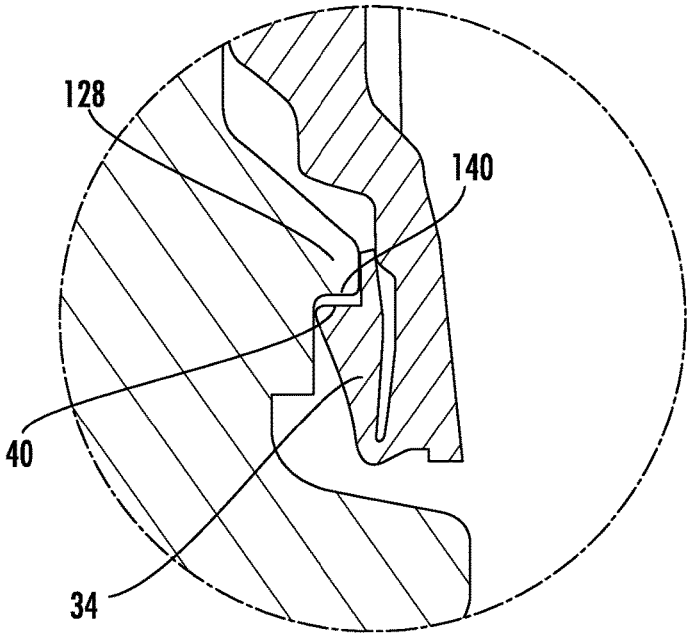
FIG. 6B is a detailed perspective view of a portion of the closure of FIG. 6A, according to one embodiment.

Turning to FIGS. 3A-6B, illustrated therein are various stages of closure 10 being applied to container 120. In FIGS. 3A and 3B, closure 10 includes container engagement structure 34 extending downwardly from tamper band 28 away from top panel 12. In FIGS. 4A and 4B, container engagement structure 34 is rotated in rotational direction 78 towards inner surface 48 of sidewall 46 until container engagement structure 34 extends upwardly from tamper band 28 towards top panel 12. FIGS. 5A, 5B and 5C depict closure 10 being applied to container 120 at the point when container engagement structure 34 is pivoted towards and ultimately against inner surface 48 of sidewall 46 resulting in sidewall 46 being deflected away from longitudinal axis 14. Container engagement structure 34 is pivoted into and partially received in recess 54 and as a result recess 54 reduces the deflection of sidewall 46 for closure 10 to be fully applied to container 120. During the incidents when frangible connections 30 break during the application of closure 10 to container 120, it often occurs at the point depicted in FIG. 5A when the deflection of sidewall 46 is greatest. In FIGS. 6A and 6B, closure 10 is fully affixed to container 12. Container engagement structure 34 of closure 10 engages against restricting surface 140 of tamper-evident band 128 so that when closure 10 is removed from closure 120 the interface between container engagement structure 34 and restricting surface 140 exerts a pulling force on frangible connections 30 until frangible connections 30 break. After frangible connections 30 break then tamper band 28 remains on container 120, at least temporarily, while closure 10 with top panel 12 and skirt 18 is removed from container 120 allowing the removal of the contents in container 120.

Turning more particularly to FIGS. 3A-4B, closure 10 includes container engagement structure 34 affixed to tamper band 28 by connection point 52 proximate bottom 76 of sidewall 46. Container engagement structure 34 pivots around connection point 52 such as in first direction 78, which rotates container engagement structure 34 towards interior surface 48 of sidewall 46.

Container engagement structure 34 comprises engagement surface 40, with width 42, and protrusion 36 with width 58 that extends height 44 from engagement surface 40 to end 38. Exterior surface 50 of sidewall 46 faces away from central longitudinal axis 14. Internal surface 48 of sidewall 46, opposite exterior surface 50, includes recess 54 in which container engagement structure 34 is received. Width 56 is the width of sidewall 46 at connection point 52.

Recess 54 provides an area into which container engagement structure 34 can be rotated and ultimately displaced while closure 10 is applied to container 120. Recess 54 is a deflection of interior surface 48 in a direction towards exterior surface 50 and away from longitudinal axis 14. Recess 54 is delimited by top point 80 and bottom point 82, which collectively comprise periphery 84 of recess 54. In one embodiment, top point 80 and bottom point 82 encircle sidewall 46 at a uniform respective distance from connection point 52 forming an annular volume for recess 54.

Turning to FIGS. 5A, 5B and 5C, as closure 10 is applied to container 120 tamper-evident band 128 exerts a force on container engagement structure 34 into first position 90 against inner surface 48 of sidewall 46 in recess 54, resulting in a slight deflection of sidewall 46. This deflection of sidewall 46 exerts a force on frangible connections 30 and this is the time when frangible connections 30 occasionally break.

Turning even more specifically to FIG. 5C, top and bottom points 80, 82 define plane 86 that extends between and through top and bottom points 80, 82. Width 62 of sidewall 46 is the smallest width of sidewall 46 between top and bottom points 80, 82, width 66 is the width of sidewall 46 at top point 80, width 98 is the width of sidewall 46 at bottom point 82, and width 64 is the width of sidewall 46 coplanar with engagement surface 40 of engagement surface 34. Maximum depth 88 of recess 54 is the maximum depth of recess 54 as measured perpendicularly from plane 86 towards interior surface 48 of sidewall 46.

Recessed width 92 is the width of container engagement structure 34 disposed within recess 54 when container engagement structure 34 is in first position 90. Non-recessed width 94 is the width of container engagement structure 34 disposed outside recess 54 when container engagement structure 34 is in first position 90. It will be observed that the delineation between recessed width 92 and non-recessed width 94 is defined by plane 86, which itself defines recess 54 and extends between top point 80 of recess 54 and bottom point 82 of recess 54. Collectively recessed width 92 and non-recessed width 94 comprise total width 96.

In one embodiment, recessed width 92 is at least 10% of total width 96. That 10% of total width 96 disposed within recess 54 results in a correspondingly reduced deflection of sidewall 46 when container engagement structure 34 is located in first position 90. In one embodiment recessed width 92 is at least 15% of total width 96. In yet another embodiment recessed width 92 is at least 20% of total width 96. In yet another embodiment recessed width 92 is at least 25% of total width 96. Similar to for the 10% condition, those respective percentages of total width 96 within recess 54 each result in a correspondingly reduced deflection of sidewall 46 when container engagement structure 34 is located in first position 90.

Turning to FIGS. 6A and 6B, after closure 10 is applied to container 120, container engagement structure 34 is biased away from inner surface 48 of sidewall 46 because of protrusion 36. When closure 10 is being applied to container 120, during first position 90 at the moment of greatest deflection of sidewall 46, protrusion 36 is correspondingly biased away from the vertical, with respect to engagement surface 40 (best shown in FIG. 5B). After closure 10 has been applied to container 120 then protrusion 36 biases back towards the natural orientation of extending perpendicularly from engagement surface 40. As a result of the bias of protrusion 36 towards being straight again, container engagement structure 34 biases away from inner surface 48, thus facilitating the interface between engagement surface 40 and restricting surface 140.

In various embodiments container 120 may comprise any number of inlets 122 (e.g., PET neck finish 122). Outer surface 124 of container 120 comprises thread 126, tamper evident band 128, and transfer band 134. Recess 130 extends between tamper evident band 128 and transfer band 134. Restricting surface 140, having width 132, of tamper evident band 128 interfaces against engagement surface 40 of container engagement structure 34. Transition 136 defines the corner between recess 130 and tamper evident band 128. In various embodiments transition 136 is sufficiently angled to prevent or reduce the chances of container engagement structure 34 slipping off tamper evident band 128 when closure 10 is being removed without forcing the breakage of frangible connections 30.

Tamper band 28 optionally further includes drain holes (not shown), which are arranged periodically around the tamper band 28. In various embodiments, closure 10 is configured to seal a container configured to hold consumable or edible products (e.g., beverages, water, food, etc.). In various embodiments, closure 10 is configured to seal a container that is a molded (e.g., blow-molded) thermoplastic beverage container configured to hermetically hold a beverage (e.g., water, juice, fortified or nutrient water, tea, sports drink, energy drink, milk, milk-based beverages, etc.). In other embodiments, closure 10 can be used to seal a wide variety of containers including pouches, jars, metal bottles, paper board cartons, etc.

In various embodiments, the closures 10 discussed herein may be formed from a plastic or polymer material. In various embodiments, the closures 10 may be formed by injection molding or by compression molding. For example, the closures 10 may be injection molded from a polypropylene homopolymer resin. In specific embodiments, the closures 10 may be made from a clear (e.g., translucent or transparent) polypropylene homopolymer resin, or they may be made from a clear random copolymer polypropylene. In various embodiments, the clear material of the closure 10 is such that the engagement structure (e.g., thread 26) is visible from the outside of the closure 10 through skirt 18.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. It should also be understood that the terminology is for the purpose of description only and should not be regarded as limiting.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

We claim:

1. A closure comprising:

a generally circular top panel centered about a vertical axis and comprising an upper surface, a lower surface and an outer periphery;

a skirt extending downward and away from the outer peripheral edge of the top panel, the skirt comprising an inner surface;

a thread formed about the inner surface of the skirt;

frangible connections that provide a visual indication, when broken, that the closure has been opened; and a tamper band that decouples from the skirt after the frangible connections are broken, the tamper band comprising:

a sidewall coupled to the frangible connections, the sidewall comprising an inner surface facing towards the vertical axis, the inner surface comprising a recess; and a container engagement structure pivotably coupled to the sidewall via a connection point, the container engagement structure pivoting in a first rotational direction into the recess, the container engagement structure comprising a generally flat engagement surface and an extension that protrudes from the engagement surface, wherein when the container engagement structure pivots into the recess, the extension interfaces against the sidewall of the tamper band thereby biasing the container engagement structure towards the vertical axis.

2. The closure of claim 1, the container engagement structure comprising an end opposite the connection point, the recess comprising a top point and a bottom point each defining a periphery of the recess, the sidewall comprising a smallest width of the sidewall between the top point and the bottom point, the sidewall comprising a top width of the sidewall at the top point, the smallest width being less than the top width.

3. The closure of claim 1, the recess comprising a top point and a bottom point each defining a periphery of the recess, a plane extending between the top point to the bottom point, the recess comprising a maximum depth that is a maximum distance perpendicular to the plane from the sidewall inner surface.

4. The closure of claim 1, the container engagement structure comprising a first position in which the container engagement structure interfaces against the inner surface of the sidewall within the recess, the container engagement structure comprising a recessed width that is a maximum disposed width of the container engagement structure within the recess while the container engagement structure is in the first position, the container engagement structure comprising a non-recessed width that is a width of the container engagement structure external to the recess and coplanar with the recessed width while the container engagement structure is in the first position, the recessed width being at least 10% of the total of the recessed width and the external width.

5. The closure of claim 4, the recessed width being at least 15% of the total of the recessed width and the external width.

6. The closure of claim 4, the recessed width being at least 20% of the total of the recessed width and the external width.

7. The closure of claim 4, the recessed width being at least 25% of the total of the recessed width and the external width.

8. The closure of claim 1, the closure being configured to couple with a container inlet comprising a top surface and an outer surface, the outer surface comprising a thread, a tamper-evident band further from the top surface than the thread, a transfer band further from the top surface than the tamper-evident band, and a recess between the tamper-evident band and the transfer band, the container engagement structure engaging against the tamper-evident band.

9. The closure of claim 1, the closure further comprising:

a generally annular first plug extending downwards from the lower surface of the top panel, the first plug being located radially inwards relative to the outer periphery of the top panel;

a generally annular second plug extending downwards from the lower surface of the top panel, the second plug being located radially between the first plug and the outer periphery of the top panel, the first plug extending downward further than the second plug; and a generally annular third plug extending downwards from the lower surface of the top panel, the third plug being located radially between the second plug and the outer periphery of the top panel, the third plug extending further than the second plug and the first plug extending further than the third plug.

10. A closure comprising:

a generally circular top panel centered about a vertical axis and comprising an upper surface, a lower surface and an outer periphery;

a skirt extending downward and away from the outer peripheral edge of the top panel, the skirt comprising an inner surface;

a thread formed about the inner surface of the skirt;

frangible connections that provide a visual indication, when broken, that the closure has been opened; and a tamper band that decouples from the skirt after the frangible connections are broken, the tamper band comprising:

a sidewall coupled to the frangible connections, the sidewall comprising:

an inner surface facing towards the vertical axis, the inner surface comprising a recess comprising a top point and a bottom point each defining a periphery of the recess;

a smallest width of the sidewall between the top point and the bottom point;

a top width of the sidewall at the top point that is greater than the smallest width; and a bottom width of the sidewall at the bottom point that is greater than the smallest width; and a container engagement structure pivotably coupled to the sidewall via a connection point, the container engagement structure pivoting in a first rotational direction into the recess, the container engagement structure comprising an end opposite the connection point, the container engagement structure comprising a generally flat engagement surface and an extension that protrudes from the engagement surface, wherein when the container engagement structure pivots into the recess, the extension interfaces against the sidewall of the tamper band thereby biasing the container engagement structure towards the vertical axis.

11. The closure of claim 10, the container engagement structure comprising a first position in which the container engagement structure interfaces against the recess, the container engagement structure comprising a recessed width that is a maximum disposed width of the container engagement structure within the recess while the container engagement structure is in the first position, the container engagement structure comprising a non-recessed width that is a width of the container engagement structure external to the recess and coplanar with the recessed width, the recessed width being at least 10% of the total of the recessed width and the external width.

12. The closure of claim 11, the recessed width being at least 20% of the total of the recessed width and the external width.

13. The closure of claim 10, the closure further comprising:

a generally annular first plug extending downwards from the lower surface of the top panel, the first plug being located radially inwards relative to the outer periphery of the top panel;

a generally annular second plug extending downwards from the lower surface of the top panel, the second plug being located radially between the first plug and the outer periphery of the top panel, the first plug extending downward further than the second plug; and a generally annular third plug extending downwards from the lower surface of the top panel, the third plug being located radially between the second plug and the outer periphery of the top panel, the third plug extending further than the second plug and the first plug extending further than the third plug.

14. A closure comprising:

a generally circular top panel centered about a vertical axis and comprising an upper surface, a lower surface and an outer periphery;

a skirt extending downward and away from the outer peripheral edge of the top panel, the skirt comprising an inner surface;

a thread formed about the inner surface of the skirt;

frangible connections that provide a visual indication, when broken, that the closure has been opened; and a tamper band that decouples from the skirt after the frangible connections are broken, the tamper band comprising:

a sidewall coupled to the frangible connections, the sidewall comprising:

an inner surface facing towards the vertical axis, the inner surface comprising a recess comprising a top point and a bottom point each defining a periphery of the recess;

a smallest width of the sidewall between the top point and the bottom point; and a bottom width of the sidewall at the bottom point that is greater than the smallest width;

a container engagement structure pivotably coupled to the sidewall via a connection point, the container engagement structure pivoting in a first rotational direction into the recess, the container engagement structure comprising an end opposite the connection point, the container engagement structure comprising a generally flat engagement surface and an extension that protrudes from the engagement surface, wherein when the container engagement structure pivots into the recess, the extension interfaces against the sidewall of the tamper band thereby biasing the container engagement structure towards the vertical axis.

15. The closure of claim 14, the container engagement structure comprising a first position in which the container engagement structure interfaces against the recess, the container engagement structure comprising a recessed width that is a maximum disposed width of the container engagement structure within the recess while the container engagement structure is in the first position, the container engagement structure comprising a non-recessed width that is a width of the container engagement structure external to the recess and coplanar with the recessed width, the recessed width being at least 10% of the total of the recessed width and the external width.

16. The closure of claim 15, the recessed width being at least 20% of the total of the recessed width and the external width.

17. The closure of claim 14, the closure further comprising at least one of a generally annular first plug, a generally annular second plug and a generally annular third plug, the generally annular first plug extending downwards from the lower surface of the top panel, the first plug being located radially inwards relative to the outer periphery of the top panel;

the generally annular second plug extending downwards from the lower surface of the top panel, the second plug being located radially between the first plug and the outer periphery of the top panel, the first plug extending downward further than the second plug; and the generally annular third plug extending downwards from the lower surface of the top panel, the third plug being located radially between the second plug and the outer periphery of the top panel, the third plug extending further than the second plug and the first plug extending further than the third plug.

* * * * *